United States Patent [19]

Pagani et al.

[11] Patent Number: 4,621,500

[45] Date of Patent: Nov. 11, 1986

[54] REFRIGERATION SYSTEM

[75] Inventors: R. F. Pagani; Kenneth J. Clarke; Eric J. Avon, all of Pointe Claire, Canada

[73] Assignee: Conterm International Terminals, Inc., Pointe Claire, Canada

[21] Appl. No.: 662,375

[22] Filed: Oct. 18, 1984

[51] Int. Cl.[4] ..... F17C 1/00

[52] U.S. Cl. ..... 62/45; 62/239; 62/514 R

[58] Field of Search ..... 62/45, 239, 514 R, 457

[56] References Cited

U.S. PATENT DOCUMENTS

| | | | |
|---|---|---|---|
| 3,166,913 | 1/1965 | Carter | 62/514 R |
| 3,241,329 | 3/1966 | Fritch, Jr. et al. | 62/514 R |
| 3,271,970 | 9/1966 | Berner | 62/514 R |
| 3,308,630 | 3/1967 | Fritch, Jr. et al. | 62/239 |
| 3,421,340 | 1/1969 | Von Berg | 62/239 |
| 3,561,226 | 2/1971 | Rubin | 62/514 R |
| 3,705,500 | 12/1972 | Jehle | 62/514 R |
| 3,714,793 | 2/1973 | Eigenbrod | 62/514 R |
| 4,041,725 | 8/1977 | Garside | 62/223 |
| 4,129,432 | 10/1983 | Garside | 62/223 |
| 4,300,356 | 11/1981 | Notaro et al. | 62/457 |
| 4,407,144 | 10/1983 | Garside | 62/239 |

*Primary Examiner*—Ronald C. Capossela

*Attorney, Agent, or Firm*—Samuel Meerkreebs

[57] ABSTRACT

In a refrigerant system for use in cooling the interior of an insulated chamber, the system including at least one fluid reservoir and possibly one or more conduits linked thereto any or all of which may also comprise a reservoir, the system effecting the cooling by means of direct contact of the conduit with the interior of the insulated chamber whereby to achieve a desired refrigerating effect therein, the improvement comprising: insulating with insulation material the reservoir and the conduits if present, to prevent or to substantially prevent direct contact of the same with the interior of the chamber thereby providing a refrigerated barrier intermediate the interior and exterior of the chamber.

12 Claims, 6 Drawing Figures

REFRIGERATION SYSTEM

BACKGROUND OF THE INVENTION (a) Field of the Invention

The present invention relates to an improved refrigeration system for use in cooling the interior of a chamber, the system including a fluid reservoir and possibly one or more conduits linked thereto, any or all of which may also comprise a reservoir.

(b) Description of Prior Art

Various refrigeration systems of the aforementioned type are known as exemplified by applicant's U.S. Pat. Nos. 4,129,432, dated Dec. 12, 1978 and 4,407,144, dated Oct. 4, 1983. Although these known systems function satisfactorily, they do not operate whereby the amount of liquid $CO_2$ or any other product having similar properties, inside the conduits i.e., pipes or cylinders, can be controlled to offset the heat transfer from the outside to the inside of the container before it reaches the interior of the chamber. In other words, the systems do not provide, whereby the heat that is being transferred through the container wall by the outside of container ambient temperature, is substantially absorbed by the $CO_2$ liquid in the conduits of the system before it is able to penetrate the container wall or at least an area thereof, thereby allowing a product in the chamber to more effectively maintain or substantially maintain a selected even temperature.

SUMMARY OF THE INVENTION

It is therefore a prime object of the present invention to provide an improved refrigeration system which will overcome the aforementioned disadvantage.

In one aspect of the present invention, there is provided in a refrigerant system for use in cooling the interior of an insulated chamber, the system including at least one fluid reservoir and possibly one or more conduits linked thereto any or all of which may also comprise a reservoir, the system effecting the cooling by means of direct contact of the conduit with the interior of the insulated chamber whereby to achieve a desired refrigerating effect therein, the improvement comprising: insulating with insulation material the reservoir and the conduits if present, to prevent or to substantially prevent direct contact of the same with the interior of the chamber thereby providing a refrigerated barrier intermediate the interior and exterior of the chamber.

In a further aspect of the present invention there is provided a chamber including a refrigerant system associated therewith, the system comprising at least one conduit carrying coolant therein, the chamber comprising top, bottom and side walls, accordingly defining an interior and an exterior to the chamber, one of the walls comprises a door affording access into the chamber, each of the walls being insulated with insulating material, at least one of the walls comprising a first layer of the insulating material extending thereover adjacent the exterior, a second layer of the insulating material extending thereover adjacent the interior and at least one conduit of the refrigerant system intermediate the first and second layers of insulating material thereby isolating the conduit from both the interior and exterior, and whereby heat transfering through the at least one wall is substantially absorbed by the coolant and the insulating material cooled by the coolant, before it is able to penetrate through the at least one wall, permitting a product placed in the chamber to effectively maintain or substantially maintain a selected even temperature.

In a further aspect of the present invention, there is provided a method of refrigerating a product comprising the steps of placing a product in a chamber, which chamber comprises walls insulated with insulating material; and cooling the interior of at least one of the insulated walls with a controllable cooling means isolated from the interior and the exterior of the chamber by the insulating material, whereby to offset heat transfer through the wall from the exterior to the interior of the chamber before it reaches the interior of the chamber and thus the product.

BRIEF DESCRIPTION OF THE DRAWINGS

The invention is illustrated by way of example in the accompanying drawings wherein.

DESCRIPTION OF PREFERRED EMBODIMENTS

Figure 1:
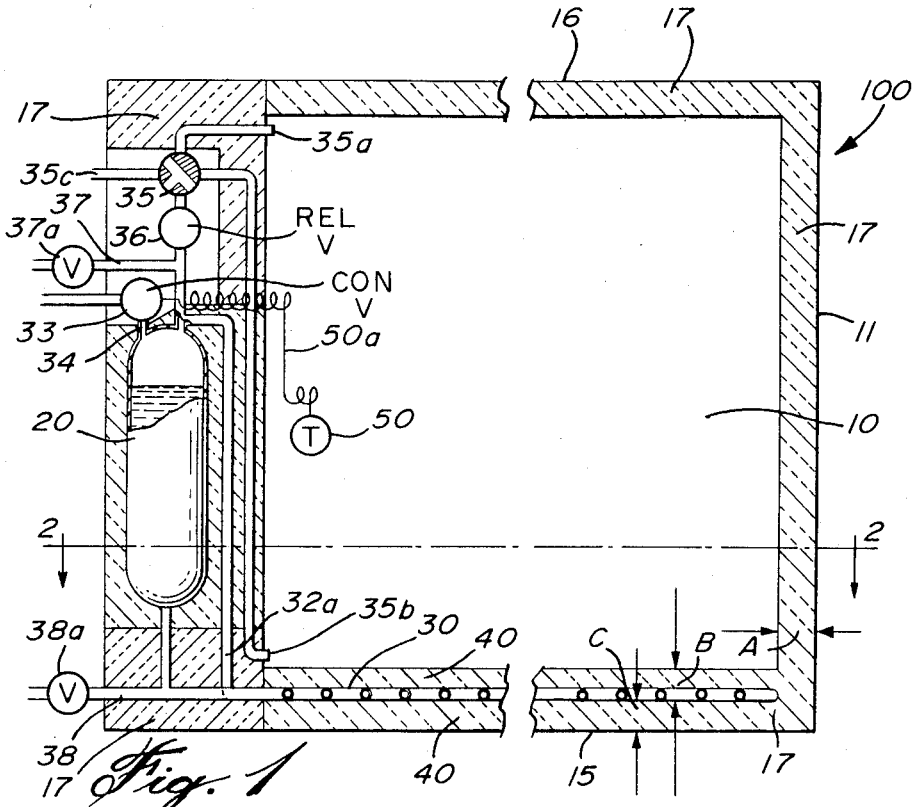
FIG. 1 is a side elevational cross-sectional view taken through a storage container in accordance with the present invention.
Figure 2:
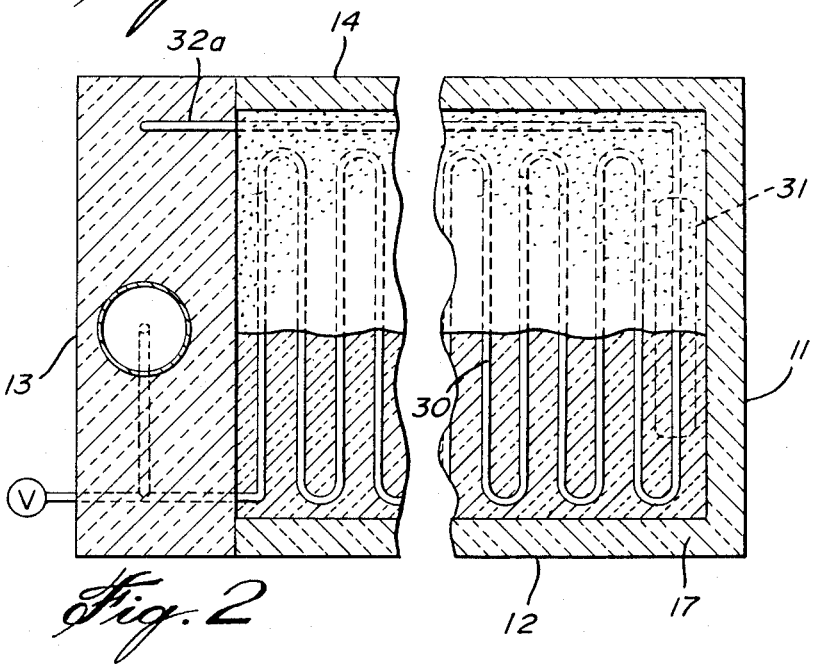
FIG. 2 is a cross-sectional view taken along line 2—2 in FIG. 1.

Referring now in detail to the drawings, FIG. 1 discloses a fluid refrigerant system 100 for use in cooling the interior of insulated chamber 10 and having a fluid reservoir 20 and a conduit 30 linked thereto. As seen in FIG. 2, conduit 30 may comprise any configuration including, if desired, one or more reservoir portions 31, a feature of prior art designs. Unlike the prior art designs, however, conduit 30, as seen in FIG. 1 for example, is insulated with insulating material 40 whereby to prevent or substantially prevent, as is not the case in the prior art designs, direct contact of conduit 30 or reservoir(s) 31 with the interior of chamber 10. Accordingly, insulated conduit 30 and reservoir(s) 31 if present, provide a refrigerated barrier intermediate the interior and exterior of chamber 10.

Referring further to FIG. 1, being but one preferred embodiment of the invention, there is shown a temperature sensor means 50 for controlling the internal pressure of reservoir 20, thereby controlling the cooling temperature of system 100 to a predetermined set point. As will be noted from FIG. 1, sensor means 50 is arranged to communicate with the interior of chamber 10 and includes capillary **50*a*. Sensor means 50 may comprise any well known suitable type. Sensor means 50 may also control, by means of a temperature differential between the outside ambient and the system temperature. In such instance, sensor means 50 will extend outside (not shown) in the ambient air, or as indicated, by presetting an internal desired temperature on sensor means 50 located within chamber 10**.

Insulated chamber 10 may comprise any suitable structure including that of well known shipping containers, railcars and the like. Construction details of such are deemed well known to those skilled in the art to which the present invention is directed. Although the system according to the present invention may be accommodated in existing structures, it is envisaged custom designed shipping containers, railcars and the like, may be provided and which will accommodate various parts of the system according to the present invention.

One major advantage of the present invention is that it permits present systems, such as the aforementioned patented ones, to be readily modified in accordance with the present invention.

Attention is again directed to system 100 shown in FIGS. 1 and 2. In this instance, chamber 10 includes sidewalls 11, 12, 13 and 14, floor 15 and roof 16, comprising insulating material 17. Insulating material 17 may of any suitable well known type including fiberglass. In the case of the embodiments shown, the same type of insulation is used in all walls 11 through 14, floor 15 and roof 16, resulting in a difference of insulation thickness defined by dimensions A, B and C, shown in FIG. 1. Dimensions B and C it will be noted, are less than dimension A ensuring that heat traveling from inside chamber 10 toward the outside thereof or alternatively from outside chamber 10 toward the inside thereof, will reach conduit 30 before such heat will pass through non-refrigerated wall 11, for example. It will be evident that thicknesses A, B and C could be made similar, should such be desired, and achieve a similar result to that described above, if different materials, i.e., ones having a different K factor are utilized in walls 11 and 15, for example. Preferably, the insulation extends in between the plane of the loops of conduit 30 and 30*a*.

As further seen from FIG. 1, insulation material 17 completely surrounds conduit 30 and the lead piping servicing the same, isolating it from chamber 10 and the exterior surface thereof. Insulation material 17 also completely surrounds reservoir 20 to insulate it from chamber 10 and the exterior surface thereof. A similar structural result may of course be achieved by using selected systems of the prior art, such as that shown in U.S. Pat. No. 4,407,144, which is incorporated herein by reference, and adding thereto insulating material over the cooling conduits thereof, whereby to insulate said latter mentioned conduits from the interior of the storage chamber. In such instance, the prior art reservoir would be likewise insulated and sensor means 50 or equivalent, operably connected thereto. Such demonstrates the flexibility afforded by the present invention in upgrading the prior art systems.

It will be evident from the foregoing, reservoir 20 comprises a well known type.

Conduit 30, it will be realized, may be selectively installed in any or all of the walls comprising chamber 10. In the case of a preferred embodiment shown, such is installed in the floor - wall. Conduit 30 may comprise any suitable configuration including that shown in FIGS. 2 and 6 denoted respectively 30 and 30*a*. As indicated previously, conduits 30 and 30*a* may comprise enlarged cross-sections of pipes thereby provided additional reservoirs 31, shown in FIGS. 2 and 3.

Figures 3, 4:
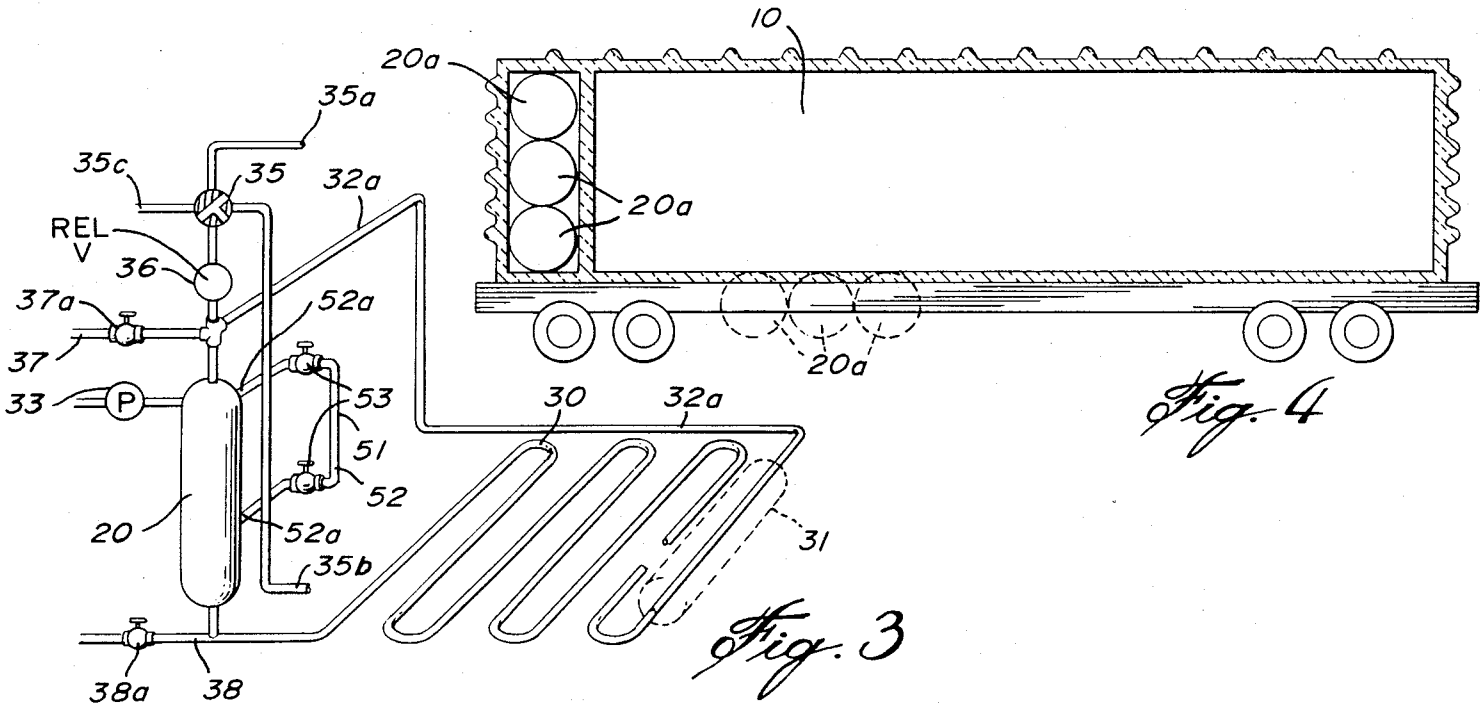
FIG. 3 is a perspective part diagrammatic view showing part of the system shown in FIG. 1, including an alternative type of temperature sensor.
FIG. 4 is a diagrammatic sectional side view of a mobile storage container in accordance with the present invention.
Figure 6:
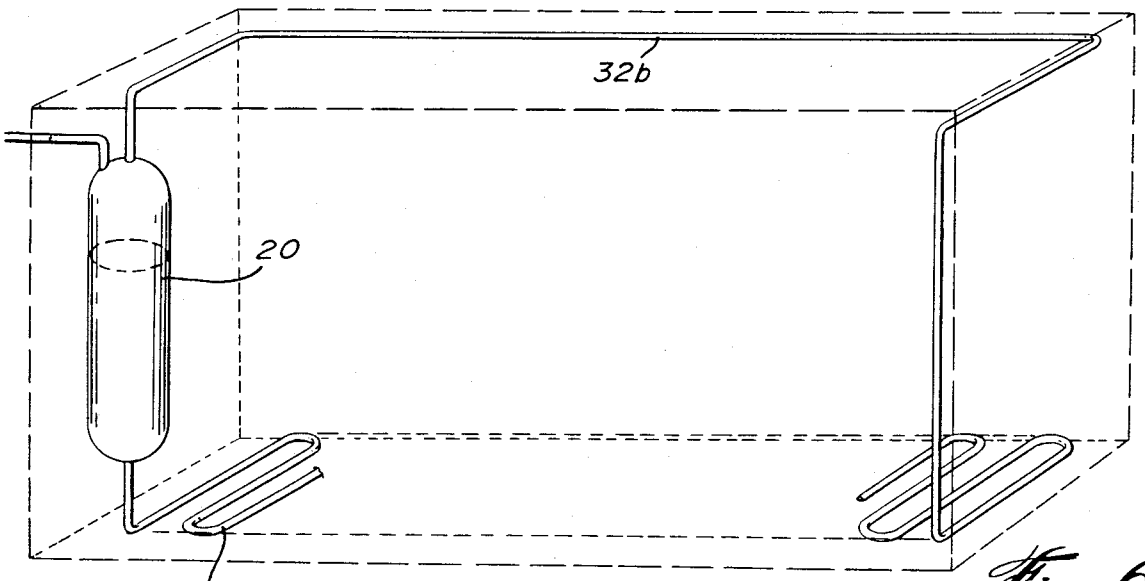
FIG. 6 is a perspective diagrammatic view of a further embodiment in accordance with the present invention.

As best seen in FIG. 3, conduit 30, like conduit 30*a* in FIG. 6, extends to join reservoir 20 via a return line denoted respectively 32*a* and 32*b* in FIGS. 1 and 6.

Referring again to the embodiment shown in FIG. 1, it is seen temperature sensor means 50 is operably connected to control pressure valve 33 communicating with reservoir 20 via a pipe 34. It is also seen from FIG. 1, a three-way valve 35 is provided for use in venting gas from the system selectively to within chamber 10 via pipe 35*a* to the top thereof or pipe 35*b* to the bottom thereof, or alternatively via pipe 35*c* to the exterior of chamber 10. A control pressure valve 36 is provided for use in controllably venting gas from the system, i.e., from the gaseous space in reservoir 20.

A gas line 37 containing a shutoff valve 37*a* extends from the top of reservoir 20 and accordingly from the gaseous space thereof. As noted, line 37 communicates with return line 32*a*.

A fluid fill line 38 for reservoir 20 is clearly seen in FIGS. 1 and 3, having therein a shutoff valve 38*a*. Although, as indicated previously, system 100 is particularly designed for use with liquid $CO_2$, it is envisaged other products having similar properties may be used in place thereof.

From the foregoing, it will be evident the present invention provides a liquid $CO_2$ expendable refrigerant system whereby the reservoir and/or a series of linked liquid conduits are embedded in or sandwiched between a chamber's insulated walls and/or floor and ceiling. When the product to be transported in the chamber is a pre-frozen item, the present system will achieve the same refrigerating effect by offsetting the chamber's heat gain by means of refrigerating its walls, floor or ceiling or any predetermined combination thereof. Further, that the system is controlled by means of a temperature sensor which will regulate the internal pressure of the system, thereby directly controlling the system temperature to a pre-determined set point. Also, that the sensor may control by means of a temperature differential between the outside ambient and the system temperatures, the sensor being outside in the ambient air or by presetting an internal desired temperature on the sensor located inside the chamber whereby as the internal temperature starts to increase, the sensor will lower the pressure/temperature of the system whereby the chamber heat gain through the insulation will be offset. Further, that the chamber is insulated in such a way in one instance, as to make the ratio of insulation thickness of non-refrigerated walls to the interior part of the insulation of the refrigerated walls greater than unity, thereby allowing the heat to travel more readily through the refrigerated walls where it can be combated. Further, that the system may be used to refrigerate an insulated container having access to the interior through a door or hatch and may be cylindrical in shape as in a refrigerated tanker.

Also, from the foregoing, it will be evident the system comprises an insulated reservoir which can be a single module or a series of interconnected modules located in the interior top, interior bottom, interior walls or any convenient exterior location, being filled with liquid $CO_2$ or equivalent and having a gaseous space, also a liquid supply line and a gas-return line. Further, that the liquid line can be a vertical riser, a horizontal unit or a combination or horizontal and ertical units, and that a temperature sensor is connected to a control pressure valve, a pressure relief valve is provided along with a three-way valve allowing the system to selectively vent gas pressure. It is noted, the return line is connected to the gaseous space of the reservoir and is connected in a most convenient manner according to orientation of the reservoir. Further, that the system has a liquid fill and a gas return with easy access to the fill system, the fill and return pipes being outfitted with manual shutoff valves to ensure no unnecessary gas leakage. Finally, that the system vent pipes connected to the three-way valve enable the system to vent gaseous $CO_2$ to the interior bottom or top of the chamber or alternatively exteriorly thereof.

Attention is once more directed to FIG. 3 wherein it will be seen an alternative type of temperature sensor means 51 is provided. Temperature sensor means 51 comprises a fluid line 52 having its terminal ends 52*a* operably connected to reservoir 20, accordingly providing an uninsulated loop line which extends to the interior of chamber 10. A pair of shutoff valves 53 are provided in line 52.

Figure 5:
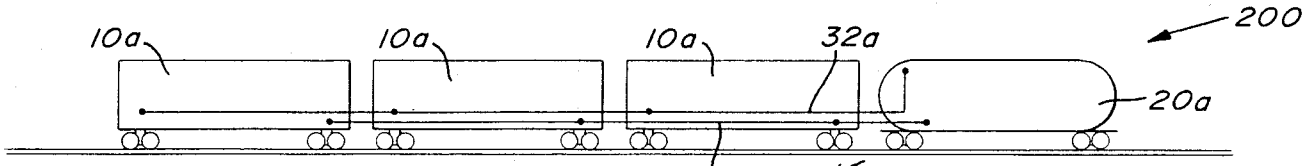
FIG. 5 is a diagrammatic side elevational view of one preferred embodiment of the system in accordance with the present invention.

Attention is directed to FIG. 5 showing a further preferred embodiment 200 according to the present invention. As seen, reservoir 20*a* comprises a mobile vehicle (road or rail) operatively linked to a plurality of mobile insulated containers 10*a* each of which comprises a conduit 30 and gas return line 32*a*, linked one to another. As will be realized, operation of embodiment 200 is similar to that described above in respect of embodiment 100. Alternatively, reservoir 20*a* and container 10*a* may be combined on a single mobile frame or chassis such as that of a railcar. Such is exemplified by FIG. 4, which again it will be understood, operates in similar manner to that aforedescribed.

As further seen in FIG. 4, alternative positions may be utilized for reservoir(s) 20*a*.

As will be understood, FIG. 5 represents a plurality of shipping containers 10*a* supported upon flat bed means (road or rail). FIG. 5 being diagrammatic, is intended also to represent custom designed refrigeration cars linked to reservoir tanker car 20*a*.

As indicated previously in respect of the embodiment shown in FIG. 1, any of the walls of the container may include the refrigeration barrier in accordance with the present invention. It is envisaged in certain cases, only a portion of a wall or walls need include such barrier.

We claim:

1. A chamber including an expandible refrigerant system associated therewith, said system comprising a reservoir containing an expandible refrigerant coolant, lead piping connecting said reservoir to a plurality of conduits carrying said coolant therein, said chamber comprising top, bottom and side walls, accordingly defining an interior and an exterior to the chamber, one of said walls comprises a door affording access into the chamber, each of said walls being insulated with insulating material, at least one of said walls comprising a first layer of said insulating material extending thereover adjacent said exterior, a second layer of said insulating material extending thereover adjacent said interior, said reservoir and said lead piping and plurality of conduits being disposed intermediate said first and second layers of insulating material thereby isolating them from both said interior and exterior, and whereby heat transferring through said at least one wall is substantially absorbed by said coolant and said insulating material cooled by said coolant, before it is able to penetrate through said at least one wall, permitting a product placed in said chamber to effectively maintain or substantially maintain a selected even temperature.

2. A chamber as defined in claim 1, wherein said coolant comprises $CO_2$.

3. A chamber as defined in claim 1, wherein a plurality of said walls comprise said first and second layers of insulating material and at least one conduit of said refrigerant system arranged in the manner defined respective said at least one wall.

4. A chamber as defined in claim 1 wherein said chamber includes a temperature sensor means for use in controlling pressure within said reservoir during operation thereof.

5. A chamber as defined in claim 4, wherein a fluid fill line is operably connected to said reservoir via the base thereof and said fill line includes a fluid shut-off valve therein.

6. A chamber as defined in claim 4, wherein said temperature sensor means comprises a fluid line having its terminal ends operably connected to said reservoir and a portion thereof extending uninsulatedly within said chamber.

7. A chamber as defined in claim 4, wherein said temperature sensor means is arranged to communicate with said exterior.

8. A chamber as defined in claim 4, wherein said temperature sensor means is arranged to communicate with said interior.

9. A chamber as defined in claim 4, wherein said temperature sensor means is operably connected to a control pressure valve communicating with said reservoir.

10. a chamber as defined in claim 4, wherein said reservoir includes a gaseous space therein, a fluid return line is operably connected to said gaseous space and a three way valve is operably connected to said gaseous space for use in venting gas therefrom selectively to said interior or said exterior.

11. A chamber as defined in claim 10, wherein said reservoir includes a control pressure valve operably connected thereto for use in controllably venting gas from said gaseous space.

12. A chamber as defined in claim 10, including a gas line operably connected to said fluid return line and gaseous space, said gas line including a shut-off valve.

* * * * *